US006315629B1

(12) United States Patent
Jones

(10) Patent No.: US 6,315,629 B1
(45) Date of Patent: Nov. 13, 2001

(54) BOTTLE ROCKET LAUNCHER

(75) Inventor: Gary W. Jones, Joplin, MO (US)

(73) Assignee: Pitsco, Inc., Pittsburg, KS (US)

( * ) Notice: Subject to any disclaimer, the term of this patent is extended or adjusted under 35 U.S.C. 154(b) by 0 days.

(21) Appl. No.: 09/481,313

(22) Filed: Jan. 11, 2000

(51) Int. Cl.[7] ..... A63H 27/26
(52) U.S. Cl. ..... 446/212
(58) Field of Search ..... 446/56, 187, 211, 446/212, 400; 124/56, 61, 63, 69, 70, 57, 75

(56) References Cited

U.S. PATENT DOCUMENTS 2,759,297 * 8/1956 Lewis .
2,927,398 * 3/1960 Kaye et al. .
3,148,478 * 9/1964 Miller .
5,839,940 * 11/1998 Ensmenger ..... 446/212

OTHER PUBLICATIONS

Page from 1998 Pitsco catalog showing Hydrolaunch bottle rocket launcher.
Pages from Pitsco 1995 catalog showing Hydro2launch and bottle rocket (6 pages).

* cited by examiner

*Primary Examiner*—Thomas Price
(74) *Attorney, Agent, or Firm*—Hovey, Williams, Timmons & Collins

(57) ABSTRACT

A bottle rocket launcher is provided for rockets constructed for educational and entertainment purposes out of synthetic resin bottles used primarily for soft drinks. The rocket launcher includes a bottle plug for filling the bottle rocket with compressed gas such as air and guiding it as it exits the launcher, a release mechanism for initially retaining and then selectively releasing the rocket adjacent its nozzle, and a base. The release mechanism provides multiple hooks which grab a rim adjacent the nozzle, and selectively and simultaneously releases each of the hooks, whereby the upward force applied by the compressed gas against the liquid causes the hooks to slide off of the rim and permits the rocket to lift off of the launcher. The bottle plug is releasably connected to the release mechanism, while a gas delivery conduit remains connected to the bottle plug for inhibiting spillage of liquid from the bottle rocket until the bottle rocket is secured to the release mechanism and filled with compressed gas prior to launch.

15 Claims, 3 Drawing Sheets

FIG. 1.
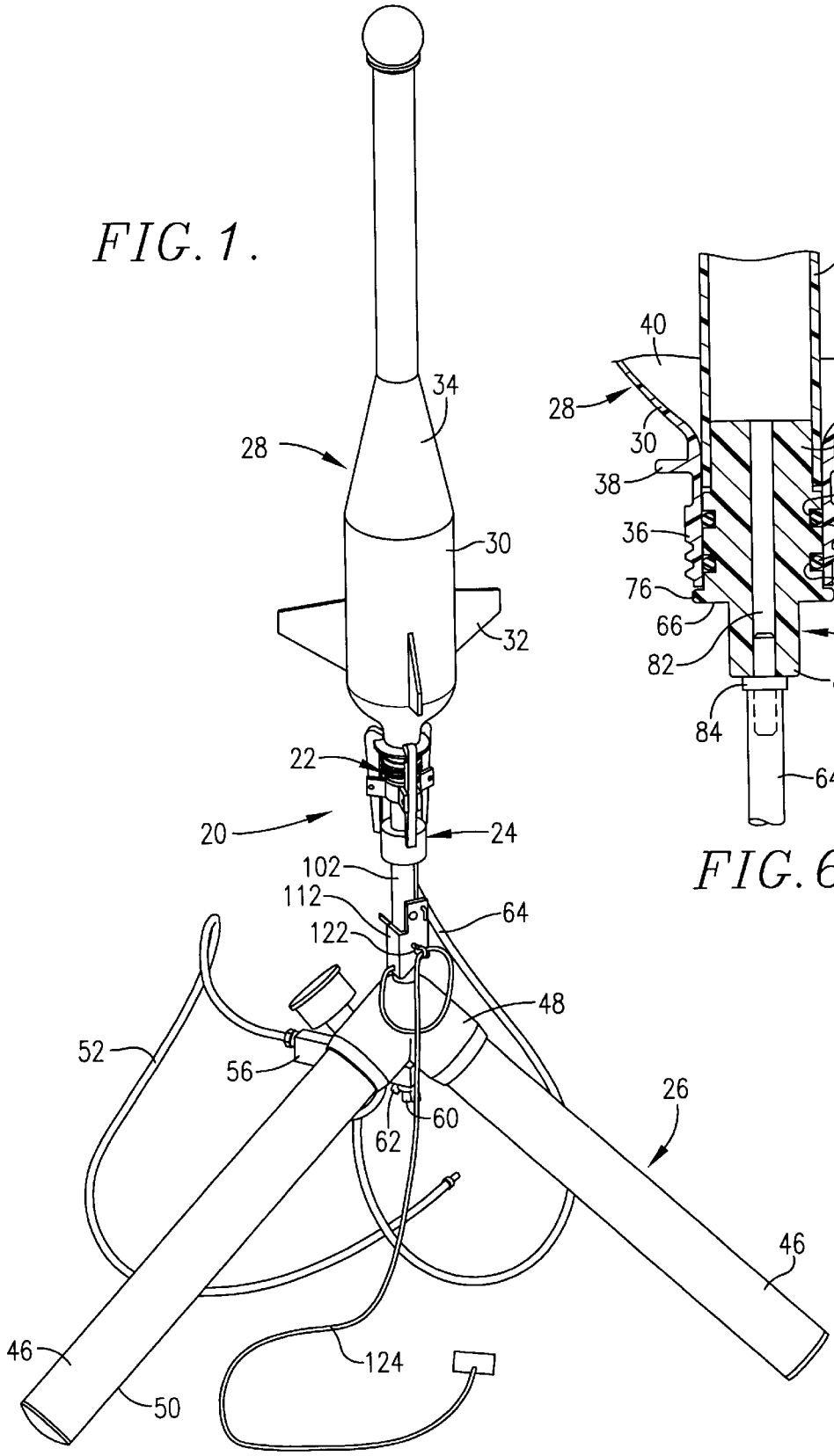
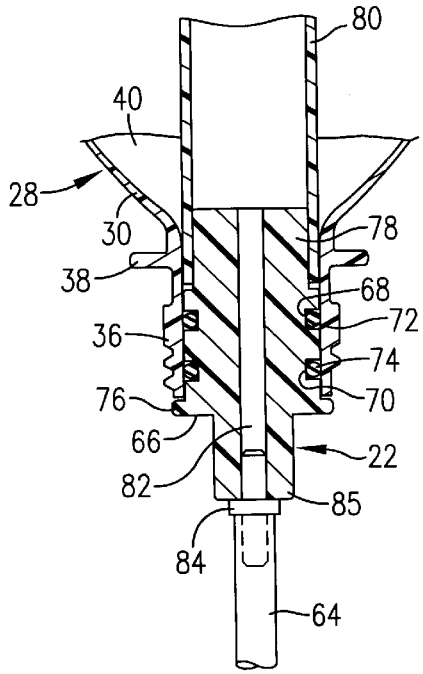
FIG. 6.

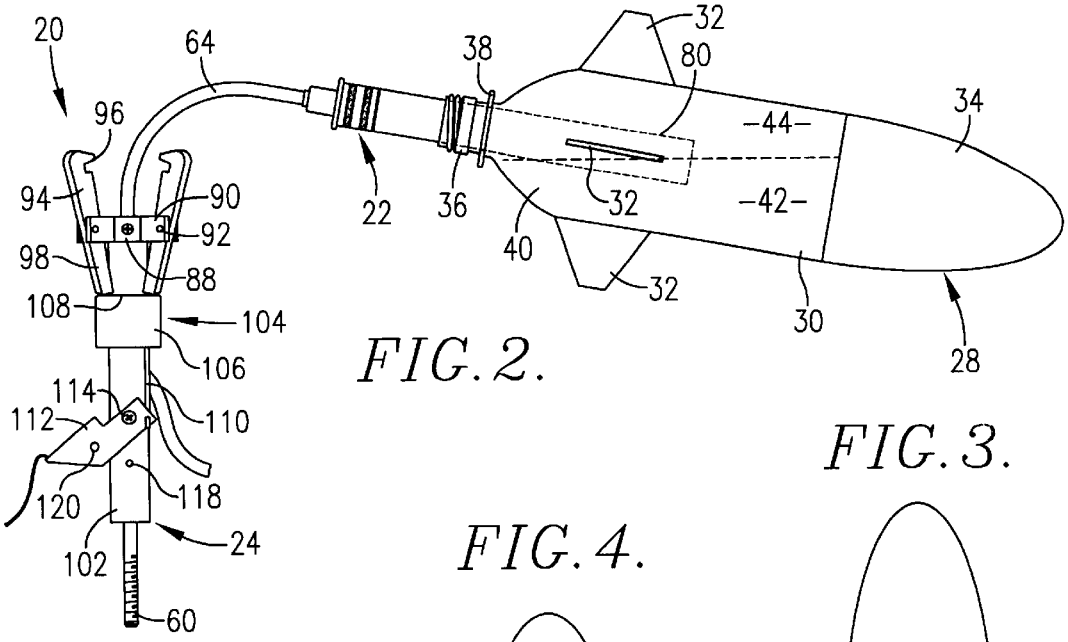
FIG. 2.
FIG. 3.
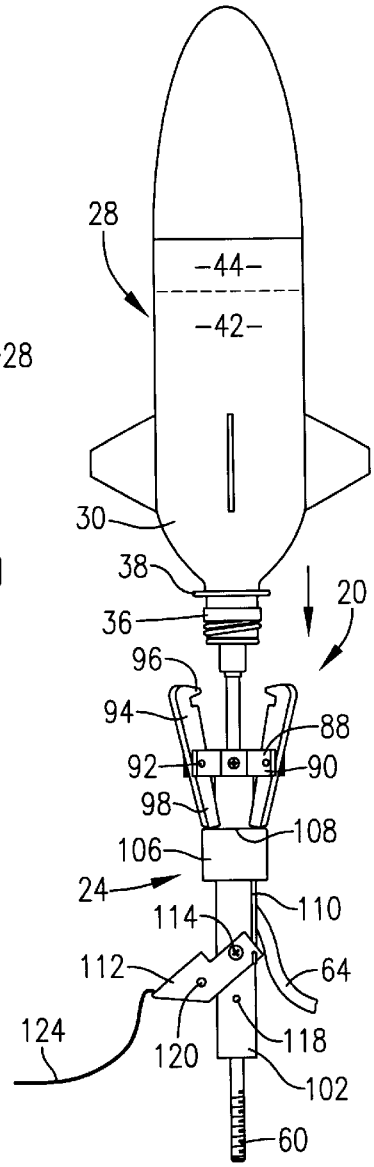
FIG. 4.
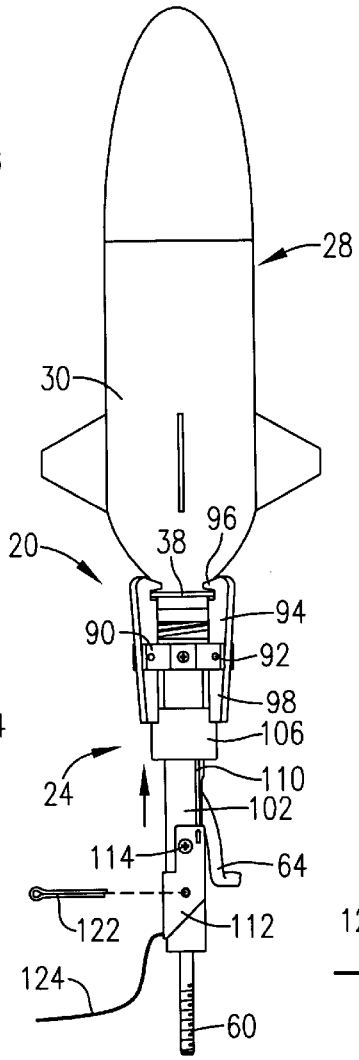
FIG. 5.
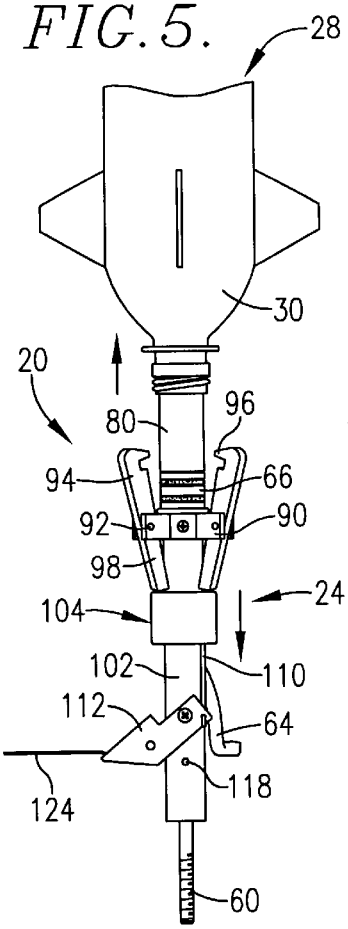

BOTTLE ROCKET LAUNCHER

BACKGROUND OF THE INVENTION

1. Field of the Invention

The present invention broadly concerns an apparatus for holding and selectively releasing compressed air model rockets. More particularly, it is concerned with a model rocket launcher which is able to hold, pressurize, and launch rockets made from plastic bottles using water and air or an inert gas as a propulsion source.

2. Description of the Prior Art

Increased focus is being provided to hands-on experimentation and practice in the education of elementary and secondary students. Students are being provided with increased opportunities to use their imagination for development of projects in the field of science, and to complement classroom study with measurement of actual results.

One such project which has enjoyed wide acceptance involves the building and launching of so-called bottle rockets. As used herein, "bottle rockets" refers to rockets made from a bottle and which uses liquid such as water and a compressed gas as the propulsion source, and not to a fireworks rocket or other combustion device. Students use standard sized plastic (usually polyethylene terphthalate) bottles as a starting point for the rocket. Such bottles are commonly sold containing carbonated soft drinks in 16 oz, 20 oz, 24 oz, 1 liter, 2 liter and 3 liter sizes. Such used soft drink bottles are especially desirable because they are of a common, predetermined volume capable of handling moderate pressurization, are inexpensive, have a threaded neck of a common, standard size and configuration. Students typically glue or otherwise attach stabilizing fins to the bottle adjacent the threaded neck which serves as a nozzle and is pointed down during launching. The bottle is made more aerodynamic by the addition of a nose cone to the base, and a parachute or similar device may be deployed from the nose cone to retard descent. The bottle rocket thus created is at least partially filled with water, and air or a relatively inert gas such as carbon dioxide is used as a propellant. The bottle rocket is released from a launcher whereupon the compressed gas bears against the water, expelling it from the threaded neck and lifting the bottle rocket by the impulse force applied in the opposite direction.

One problem associated with existing bottle rocket launchers is that the attachment between the launcher for releasing the bottle rocket may only be at one side, causing only a single point of connection and possibly causing the bottle rocket to prematurely launch or launch in an undesired launch angle. Another problem with existing launchers is that they interfere with stabilizing fins which extend far below the nozzle. In addition, large or multistage bottle rockets may tip or fall out of the launcher while being pressurized. Another problem is leakage of the liquid propellant, typically water, past the seals during pressurization and while waiting the launch. Another problem is that bottle rockets must be pressurized while on the launcher. A further problem arises when the launch is prematurely triggered by an anxious student or other accident, which may result in an unsafe situation.

As a result, there has arisen the need for an improved bottle rocket launcher which can be safely and easily used in the field.

SUMMARY OF THE INVENTION

These problems have largely been overcome by the bottle rocket launcher of the present invention. That is to say, the bottle rocket launcher hereof provides improved multiple gripping around the nozzle of the bottle rocket, improved release characteristics at launch, allows the use of fins that extend far below the nozzle so that students enjoy greater freedom in their designs, minimizes leakage prior to launch, avoids the need for anchoring the launcher because of the smooth release characteristics, permits the bottle plug with the gas supply conduit attached to be removed from the release mechanism of the launcher and inserted into the nozzle of the rocket while the rocket is held with the nose cone lower than the nozzle for preventing the water therein from spilling out, and in preferred embodiments includes a safety lock to prevent accidental launches.

Broadly speaking, the bottle rocket launcher hereof includes a bottle plug, a release mechanism, and a base. The bottle plug is configured to seal the nozzle of the bottle rocket and to receive a source of compressed gas such as air for pressurizing the bottle. The release mechanism is configured to grip the nozzle in a plurality and preferably a multiplicity of circumferentially arrayed sites, with the nozzle positioned radially intermediate the release mechanism and the plug. A base is provided for supporting and preferably elevating the plug and release mechanism whereby a variety of different designs of stabilizing fins may be used without interference by the launcher or the supporting surface.

The bottle plug includes a guide member which extends into the interior of the bottle for initial directional guidance. Advantageously, the bottle plug is releasably connected to the release mechanism and is provided with a flexible gas-filling conduit which is routed through the tubular center opening of the release mechanism. As a result, the gas supply conduit remains connected to the bottle plug and passes through the release mechanism, so that the bottle plug may be easily replaced with the release mechanism grasping the rocket to permit the bottle to be filled with compressed gas apart on launcher prior to launch.

The release mechanism preferably includes three gripping levers which are shiftably mounted to a support block for movement between a first position retaining the rocket on the launcher and a second position releasing the rocket and thereby enabling impulse of the liquid and gas exhausted from the nozzle to lift the rocket off of the launcher. The gripping levers each include a hook at one end for gripping the nozzle and an arm at the other end for engaging a release actuator. The release actuator may be rotatably mounted about the support block in one embodiment, whereby the arms are alternately blocked by stops or permitted to toggle into notches therebetween. Alternatively, the release actuator may be mounted for up and down translation, whereby in an up position the arms engage a shoulder to prevent launching, but in a down position are permitted to shift inwardly and release the hook from engagement with the nozzle. In either embodiment described herein above, the release actuator shifts relative to the support block between a first position block movement of the gripping levers and a second position permitting movement of the gripping levers. The bottle rocket actually disengages itself by simultaneously forcing the hooks out of engagement when the obstruction of the arms by the release actuator is removed, thereby providing a smoother release and a launch direction less likely to be misdirected by the active disengagement of a single hook or where the hooks are not simultaneously disengaged. A safety pin may be inserted through a toggle lever of the release actuator to prevent premature launching.

As a result, the bottle rocket launcher hereof requires less force to actuate than existing rocket launchers, more effectively guides the rocket during the initial phase of the launch, and minimizes leakage from the rocket prior to launch. These and other advantages will be appreciated by those skilled in the art with reference to the drawings and the description which follows.

BRIEF DESCRIPTION OF THE DRAWINGS

FIG. 1 is a perspective view of a first embodiment the bottle rocket launcher hereof shown with a bottle rocket attached and ready for launching;

FIG. 2 is an enlarged, fragmentary front elevational view thereof showing the bottle rocket mounted on the bottle plug and tipped to the side while positioned remote from the release mechanism to prevent leakage of water from the nozzle prior to placement of the rocket on the release mechanism and filling with compressed gas;

FIG. 3 is a an enlarged, fragmentary front elevational view showing the bottle rocket attached to the bottle plug during insertion of the nozzle onto the release mechanism;

FIG. 4 is an enlarged, fragmentary front elevational view similar to FIG. 3, showing the nozzle of the bottle rocket coupled to the gripping levers with the safety pin positioned for insertion or after removal;

FIG. 5 is an enlarged, fragmentary front elevational view similar to FIG. 4 showing the release actuator shifted out of engagement with the gripping levers to permit lift-off of the bottle rocket;

FIG. 6 is an enlarged, fragmentary vertical cross-sectional view of the bottle plug connected to the nozzle of the bottle rocket showing the sealing rings and guide member;

DESCRIPTION OF THE PREFERRED EMBODIMENT

Figures 7, 8, 9, 10, 11, 12, 13, 14, 15:
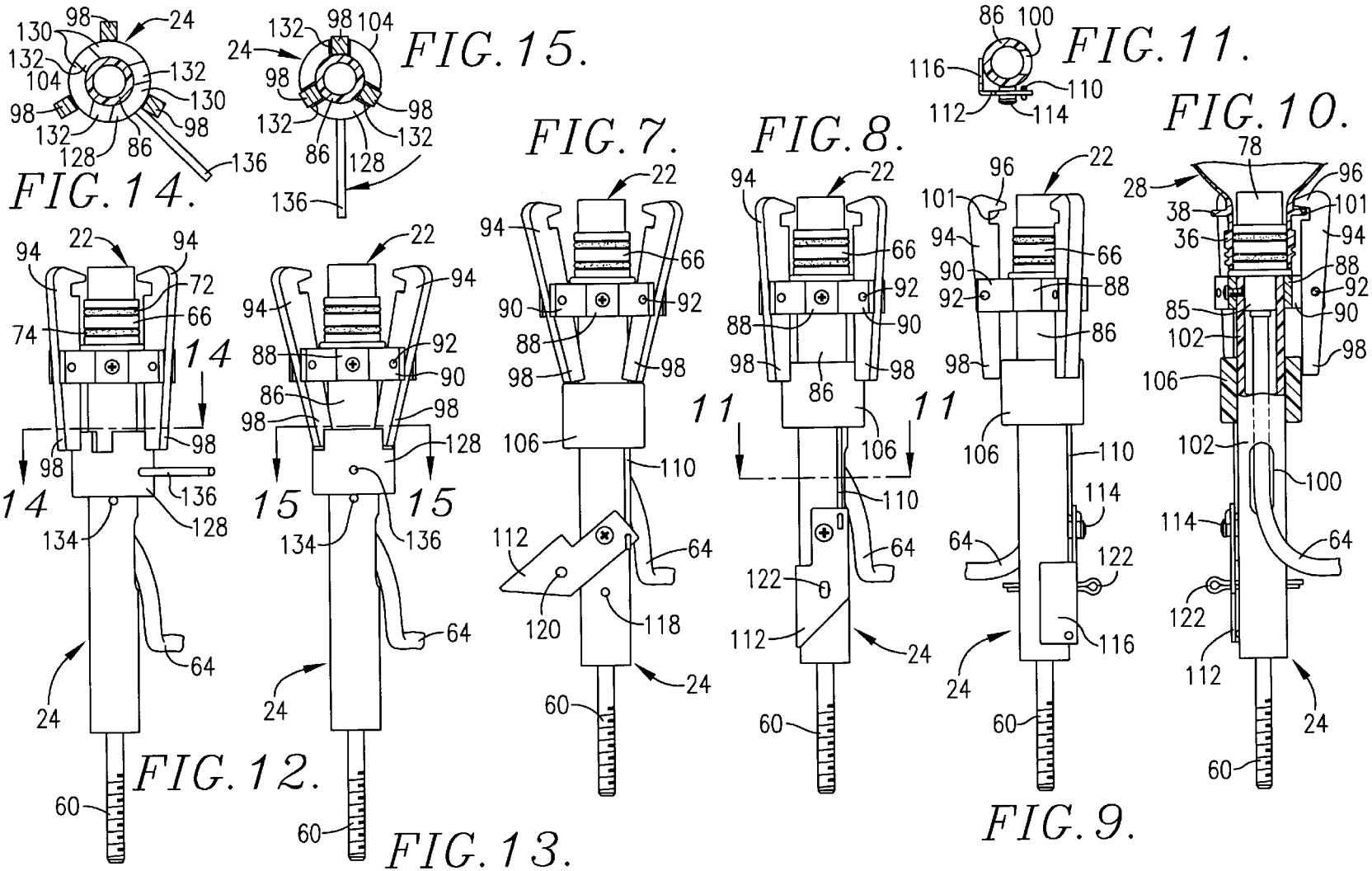
FIG. 7 is an enlarged, fragmentary front elevational view of the bottle plug with the guide tube removed and the release mechanism of the first embodiment shown with the hooks in an open position.
FIG. 8 is an enlarged, fragmentary front elevational view similar to FIG. 7 showing the release actuator shifted into blocking engagement with the arms of the gripping levers.
FIG. 9 is an enlarged, fragmentary left side elevational view similar to FIG. 8 and showing the safety pin inserted in the release toggle.
FIG. 10 is an enlarged, fragmentary right side elevational view in partial vertical cross section showing the mounting of the release actuator on the support block of the release mechanism with the safety pin inserted.
FIG. 11 is a horizontal cross-sectional view taken a long line 11—11 of FIG. 8 showing the tubular support block.
FIG. 12 is an enlarged, fragmentary front elevational view of a second embodiment of the release mechanism showing the release actuator positioned whereby the stops engage the arms of the gripping levers to maintain the hooks in a closed position.
FIG. 13 is an enlarged, fragmentary front elevational view similar to FIG. 12, showing the release actuator pivoted to permit the hooks to open and the arms received in the notches of the release actuator.
FIG. 14 is a horizontal cross-sectional view taken along line 14—14 of FIG. 12 to show the arms engaged by the stops of the release actuator.
FIG. 15 is a horizontal cross-sectional view taken along line 15—15 of FIG. 13 to show the arms received in the notches of the release actuator for opening the hooks to receive or launch the rocket on the release mechanism.

Referring now to FIG. 1 of the drawing a bottle rocket launcher 20 in accordance with the present invention broadly includes a bottle plug 22, a release mechanism 24 and a base 26. The bottle rocket launcher 20 is configured to receive a bottle rocket 28 thereon, to hold it during pressurization and preparation for launch, and to selectively release the bottle rocket 28 when desired. Typically, the bottle rocket 28 includes a bottle body 30, a plurality of radially outwardly extending stabilizing fins 32, and a nose cone 34, with the bottle body having a threaded neck which serves as a nozzle 36. The nozzle 36 includes a circumscribing rim 38 held by the release mechanism 24 until launching is desired. As shown in FIG. 2, the bottle body 30 presents a hollow chamber 40 which receives therein liquid 42, preferably water, and a gas 44, such as air or carbon dioxide, which may be compressed to expel the liquid 42 through the nozzle 36. The expulsion of the liquid 42 and compressed gas 44 from the nozzle 36 provides an impulse to propel the bottle rocket upwardly and away from the launcher 20.

In greater detail, the base 26 is shown in FIG. 2 and is provided with three legs 46, joined by a coupler 48 to form a tripod 50, although other base configurations are also suitable. A gas supply conduit 52 may be connected to a manual pump such as a bicycle pump by fitting 54 and is connected to optional gauge/release manifold 56 which limits bottle body internal pressure to a predetermined, safe maximum such as about 90 psi. The coupler 48 includes an normally vertically oriented bore for receiving thereon shaft 60 of release mechanism 24, shown in FIGS. 3–5, 7–10 and 12–13. The shaft 60 is secured to the base 26 by wingnut 62. A gas delivery conduit 64 is routed through the release mechanism 24 to fluidically connect the manifold 56 with the bottle plug 22.

As shown in FIGS. 2 and 6, the bottle plug 22 includes a nozzle mount 66 which includes circumscribing channels 68 and 70 for receiving rubber or resilient synthetic resin sealing rings 72 and 74 therein. In addition, the nozzle mount presents a radially outwardly projecting flange 76 for seating against the nozzle 36, and a neck 78 for receiving guide tube 80 thereon. The nozzle mount 66 has a longitudinally extending passage 82 for receiving nipple 84 at the lowermost end thereof. Air or other compressed gas is thus permitted to pass from the delivery conduit 64 through the nipple 84, passage 82 and guide tube 80 to chamber 40. A narrowed extension 85 is provided at the lower end of the bottle plug 22 for fitting into the release mechanism 24.

The release mechanism 24 includes a support block 86 having a pivot mount 88 coupled at the upper end of the support block 86. The pivot mount 88 has three outwardly extending brackets 90 each having a pivot pin 92 for pivotally mounting gripping levers 94 thereon. Each of the three gripping levers 94 has a hook 96 at the upper end configured for gripping the rim 38 of the nozzle 36 and an arm 98 at the lower end with a hole therebetween for receiving pivot pin 92 therethrough. The support block 86 is preferably tubular and sized to receive therein extension 85 therein and has an opening 100 in the cylindrical side wall 102 to permit passage of the delivery conduit 64 therethrough as best shown in FIG. 10. Also as shown in FIG. 10, the hooks 96 have an engagement surface 101 which is angled upwardly toward the rim 38 of the bottle rocket 28 received thereon. This angled engagement surface 101 facilitates opening of the hooks 96 and lift-off of the bottle rocket 28 when release actuator 104 is shifted from a first position blocking the arms 98 from inward movement as shown in FIGS. 1, 4, 8, 9, 10, 12, and 14 to a second position shown in FIGS. 2, 3, 5, 7, 13 and 15 permitting inward movement of the arms 98.

A release actuator 104 is shiftably mounted to the support block for movement into and out of engagement with the gripping levers 94. The release actuator 104 may be provided in at least two different preferred configurations. As shown in FIGS. 1 through 11, the release actuator 104 is provided as a collar 106 having a shoulder 108 which engages each of the arms 98 in an upwardly shifted position as shown in FIGS. 4, 8, 9 and 10, but which is positioned below the arms in a downwardly shifted position as shown in FIGS. 2, 3, 5 and 7. A control rod 110 is connected to and extends downwardly from the collar 106 to shift lever 112 which is pivotally mounted by, for example, screws 114 to the support block 86. The shift lever 112 includes a panel 116 which engages the support block 86 when in a down, engaging position. A hole 118 is provided in the shift lever 112 which is in registry with opening 120 extending transversely through the support block 86 when the shift lever 112 is in the down position. When so positioned, a safety pin 122 may be placed through the shift lever 112 and support block 86 to prevent shifting of the shift lever 112 and thus movement of the release actuator 104. As shown in FIGS. 1–5, a lanyard 124 may be passed through the eye 126 of the safety pin 122 and attached through a hole in the remote, lower end of the shift lever 112 to permit movement of the release actuator 104 from a safe distance.

In a second, alternative embodiment of the release actuator 104 shown in FIGS. 12 through 15, a collar 128 is provided which is castellated to include a plurality of upwardly extending stops 130 with notches 132 positioned circumferentially therebetween, corresponding to the circumferential spacing of the arms 98. The collar 128 is permitted to rotate about the support block 86 but prevented from moving downwardly by support peg 134. Support peg 134 thus keeps the stops 130 high enough to engage the arms 98 when the collar 128 is rotated so that the notches 132 are out of registry with the arms 98 as shown in FIG. 14. However, by moving finger 136 connected to the collar 128 to the position shown in FIG. 15, the arms 98 are permitted to move inwardly into the notches 132 and the hooks are thus permitted to detach from the rim 38 of the bottle rocket 28. The finger 136 may be provided with a lanyard, and a safety pin inserted through a hole in the collar 136 and opening in the support block to prevent premature rotation of the collar as described with reference to collar 106 above.

In use, the bottle is first partially filled with the desired amount of liquid 42 and the nozzle 36 is then placed over the bottle plug 22. The bottle plug 22 may be separated from the release mechanism 24 as shown in FIG. 2, but remain connected to a source of pressurized gas by the gas delivery conduit 64. Because the hollow chamber 40 is then charged with a supply of liquid 42 such as water, the bottle rocket 28 may be placed on the bottle plug 22 and held in a tipped position with its nozzle 36 slightly elevated as shown in FIG. 2 to inhibit leakage around the bottle plug 22 until the bottle rocket is ready to be pressurized prior to launch.

When ready to pressurize and launch the bottle rocket 28, the bottle plug 22 with the bottle rocket 28 thereon is reinserted into the support block 86 with the extension 85 inserted into the opening in the top of the support block 86. As the bottle rocket 86 moves downwardly, the hooks 96 close around the rim 38 and the arms 98 move out. Because the hooks 96 are configured to self-disengage, the release actuator 104 must be positioned in blocking relationship to the arms 98 before the handler may let go of the bottle rocket 28. The safety pin 122 may be inserted through the opening 120 and hole 118 to prevent undesired movement of the shift lever 112 and thus the collar. As shown in FIGS. 1 through 11, the collar 106 is shifted up and the shift lever consequently moved down to hold the arms 98 in position. Alternatively, as shown in FIGS. 12 through 15, the collar 128 is rotated until the arms 98 are engaged by stops 130 to spread the arms 98 and maintain the hooks 96 in engagement with the rim 38. Once the hooks 96 are secured over the circumscribing rim 38, the chamber 40 may be pressurized with gas 44. Gas such as air may be provided from, e.g., a bicycle pump connected to the fitting 54 and delivered through gas supply conduit 52, gauge/release manifold 56, and gas delivery conduit 64 to bottle plug 52. Alternatively, a carbon dioxide cartridge may provide a convenient source of suitable pressurized gas.

When it is desired to launch the bottle rocket, the base 26 is preferably placed on substantially level ground. The user may then remove the safety pin 122, and then pull on the lanyard 124 to lift the shift lever 112 and thus lower the collar 106, or alternatively to rotate the collar 128 in the second embodiment shown in FIGS. 12–15. As the arms 98 are then free to move inwardly toward the support block 86, the hooks 96 are moved outwardly as the pressure within the bottle rocket 28 causes the rim 38 to act against the hooks 96. The bottle rocket 28 then moves upwardly as shown in FIG. 5, with the guide tube 80 serving not only to direct the course of the bottle rocket 28, but also to channel and contain the liquid expelled from the nozzle 36 during launch, thereby improving launch performance.

Although preferred forms of the invention have been described above, it is to be recognized that such disclosure is by way of illustration only, and should not be utilized in a limiting sense in interpreting the scope of the present invention. Obvious modifications to the exemplary embodiments, as herein above set forth, could be readily made by those skilled in the art without departing from the spirit of the present invention.

The inventors hereby state their intent to rely on the Doctrine of Equivalents to determine and assess the reasonably fair scope of his/their invention as pertains to any apparatus not materially departing from but outside the literal scope of the invention as set out in the following claims.

What is claimed is:

1. A bottle rocket launcher for retaining and selectively releasing bottle rockets having a nozzle thereon, said launcher comprising:

a bottle plug configured for insertion into the nozzle and having a passage for fluidically connecting the rocket to a source of pressurized gas; and a release mechanism configured to mount said bottle plug thereon, said release mechanism including a support block, a plurality of gripping elements circumferentially spaced around and shiftably mounted to said support block for movement between a first bottle rocket retaining position and a second bottle rocket releasing position, and a release actuator shiftably mounted to said support block for movement between a first position blocking movement of said gripping elements from the first bottle rocket retaining position and a second position permitting movement of said gripping elements between said first bottle rocket retaining position and a second bottle rocket retaining position.

2. A bottle rocket launcher as set forth in claim 1, including a base mounting said release mechanism thereon.

3. A bottle rocket launcher as set forth in claim 1, wherein said bottle plug is removably mounted to said support block of said release mechanism.

4. A bottle rocket launcher as set forth in claim 3, wherein said bottle plug includes at least one sealing ring for inhibiting escape of liquid therepast.

5. A bottle rocket launcher as set forth in claim 3, including a gas delivery conduit fluidically connected to said bottle plug.

6. A bottle rocket launcher as set forth in claim 5, wherein said support block is tubular and has a sidewall including an opening and receiving said gas delivery conduit therethrough.

7. A bottle rocket launcher as set forth in claim 1, said support block including a plurality of brackets pivotally mounting said gripping elements thereto.

8. A bottle rocket launcher as set forth in claim 7, including a multiplicity of gripping elements and a corresponding number of brackets evenly circumferentially spaced around said support block.

9. A bottle rocket launcher as set forth in claim 7, wherein said release actuator includes a collar mounted for translational up and down movement on said support block.

10. A bottle rocket launcher as set forth in claim 9, wherein said gripping elements each include an arm engagable by said collar and a hook for holding said rocket in said first bottle rocket retaining position and configured for releasing the rocket when collar is disengaged from the arm in said second position permitting movement of said gripping elements.

11. A bottle rocket launcher as set forth in claim 9, wherein said collar simultaneously disengages from the arm of each of said gripping elements when translated downwardly on said support block.

12. A bottle rocket launcher as set forth in claim 7, wherein said release actuator includes a collar mounted for rotational movement on said support block.

13. A bottle rocket launcher as set forth in claim 12, wherein said gripping elements each include an arm engagable by said collar and a hook for holding said rocket in said first bottle rocket retaining position and configured for releasing the rocket when the collar is disengaged from the arm in said second position permitting movement of said gripping elements.

14. A bottle rocket launcher as set forth in claim 13, wherein said collar includes plurality of circumferentially spaced stops and presents a plurality of circumferentially spaced notches therebetween, whereby when said collar is in said first position said stops are positioned intermediate said support block and the arm of each gripping element, and when said collar is rotated to said second position, said notches are in registry with the arm of each of said arms thereby permitting simultaneous movement of each of said plurality of gripping elements from said first bottle rocket retaining position to said second bottle rocket releasing position.

15. A bottle rocket launcher for retaining and selectively releasing bottle rockets having a nozzle thereon, said launcher comprising:

a bottle plug configured for insertion into the nozzle and having a passage for fluidically connecting the rocket to a source of pressurized gas;

a release mechanism configured to mount said bottle plug thereon, said release mechanism including a support block releasably receiving said bottle plug therein and a plurality of gripping elements circumferentially spaced around and shiftably mounted to said support block for movement between a first bottle rocket retaining position and a second bottle rocket releasing position; and a gas delivery conduit fluidically connected to the passage of the bottle plug, said conduit passing through said support block for translation therethrough when said bottle plug is removed from said support block.

* * * * *